US009463945B2

(12) United States Patent
Herrmann

(10) Patent No.: US 9,463,945 B2
(45) Date of Patent: Oct. 11, 2016

(54) MULTI-STAGE COLLATION SYSTEM AND METHOD FOR HIGH SPEED COMPILING SEQUENTIALLY ORDERED SIGNAGE

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/582,426

(22) Filed: Dec. 24, 2014

(65) Prior Publication Data

US 2016/0185557 A1 Jun. 30, 2016

(51) Int. Cl.

*B65H 37/00* (2006.01)
*B65H 39/00* (2006.01)
*B65H 35/00* (2006.01)

(52) U.S. Cl.

CPC ..... *B65H 37/00* (2013.01); *B65H 35/008* (2013.01); *B65H 39/00* (2013.01)

(58) Field of Classification Search

CPC .... B65H 37/00; B65H 35/008; B65H 39/00; B65H 39/10; B65H 39/045; B65H 2301/4352; B65H 39/055; B65H 2301/42172; B65H 2301/4263

USPC ..... 270/18

See application file for complete search history.

(56) References Cited

U.S. PATENT DOCUMENTS

| | | | |
|---|---|---|---|
| 2,738,973 | A | 3/1956 | Koch |
| 3,355,168 | A | 11/1967 | Clausen et al. |
| 4,068,836 | A | 1/1978 | Dimopoulos |
| 5,251,892 | A | 10/1993 | No et al. |
| 5,288,062 | A | 2/1994 | Rizzolo et al. |
| 5,338,017 | A | 8/1994 | Stemmle |
| 5,709,374 | A | 1/1998 | Taylor et al. |
| 6,644,644 | B2 | 11/2003 | Vedoy |
| 6,775,588 | B1 | 8/2004 | Peck |
| 6,819,906 | B1 | 11/2004 | Herrmann et al. |
| 6,860,086 | B2 | 3/2005 | Rosloot et al. |
| 7,016,640 | B1 | 3/2006 | de Koning et al. |
| 7,123,873 | B2 | 10/2006 | deJong et al. |
| 7,213,809 | B2 | 5/2007 | Vedoy et al. |
| 7,334,789 | B2 | 2/2008 | Herrmann et al. |
| 7,421,241 | B2 | 9/2008 | deJong et al. |
| 7,494,121 | B2 | 2/2009 | Herrmann et al. |
| 8,868,231 | B2 | 10/2014 | Moore et al. |
| 2009/0234668 | A1 | 9/2009 | Wheeler |
| 2013/0041495 | A1 | 2/2013 | Moore et al. |
| 2013/0064626 | A1 * | 3/2013 | Buntemeyer ..... B65H 31/3018 412/1 |

OTHER PUBLICATIONS

"http://foxfireprinting.liveeditaurora.com/pages/who-weare">, "Who We Are", p. 1, Dec. 24, 2014.

* cited by examiner

*Primary Examiner* — Jennifer Simmons
(74) *Attorney, Agent, or Firm* — Gibb & Riley, LLC

(57) ABSTRACT

According to exemplary systems and methods, signs are created using a document-processing device. The signs are removed from a processing path of the document-processing device using a transport device to move the signs to a compiler. Ordered stacks of the signs are compiled in the compiler. The signs are temporarily held in the compiler during a first operation of a collating system. Following actuation and reset of the collating system, the signs are moved to the collating system. The collating system includes a ramped collator that moves interim stacks of signs received from the compiler from the ramps of the ramped collator toward a final collated stack according to job-specific instructions.

12 Claims, 6 Drawing Sheets

MULTI-STAGE COLLATION SYSTEM AND METHOD FOR HIGH SPEED COMPILING SEQUENTIALLY ORDERED SIGNAGE

BACKGROUND

Systems and methods herein generally relate to moving and stacking operations, and more particularly, to high speed compiling of workpieces that are output on a transport belt of a production device.

Advances in production machinery can provide flexible systems that can print, collect, compile, and stack cards, signage, and packaging products of multiple sizes and shapes. In high-speed, high-volume processes that require the pieces to be collated in sequence, receiving entities may require different numbers of pieces in a final stack. This may result in a differing number of stacks per receiving entity. To allow enough time to meet per sheet timing allowed for the last stack, the collator must reset and collate in one sheet's time. This currently is not possible before the next row of pieces is delivered. Accordingly, there is a need for a device to allow time for the collating system to actuate and reset before the next set of pieces must be collated.

SUMMARY

According to exemplary systems herein, a document-processing device is positioned along a processing path. The document-processing device creates sign workpieces. The document-processing device comprises a controller regularly receiving a series of different jobs, each of the jobs containing different job-specific instructions that each define a job-specific number and sequence of sign workpieces. A transport device is positioned along the processing path. The transport device is operatively connected to the controller. A compiler is positioned along the processing path. The compiler is operatively connected to the controller. A collating system is connected to the compiler. The collating system is operatively connected to the controller. The transport device removes the sign workpieces from the processing path and stacks the sign workpieces in the compiler as controlled by the job-specific instructions. The compiler temporarily holds the sign workpieces during a first operation of the collating system as controlled by the job-specific instructions. Following actuation and reset of the collating system, the compiler moves the sign workpieces to the collating system as controlled by the job-specific instructions. The controller independently and automatically controls operation of the compiler and actuation of the collating system based on the job instructions defining the job-specific number and sequence of sign workpieces to continuously and dynamically order and collate sign workpieces in coordination in real time with each different job-specific sequence and number of the workpieces as the workpieces are output from the transport device, without pausing between the different jobs.

According to exemplary sign processing apparatuses herein, a controller regularly receives a series of different jobs. Each of the jobs contains different job-specific instructions that each define a job-specific number and sequence of signs. A media supply supplies media to a media path. A printing engine is positioned along the media path. The printing engine prints marks on the media according to the job-specific instructions. A cutter is positioned along the media path. The cutter is operatively connected to the controller and divides the media into individual signs according to the job-specific instructions. A transport device is positioned along the media path and operatively connected to the controller. A compiler is positioned along the media path and operatively connected to the controller. A collating system is connected to the compiler and operatively connected to the controller. The transport device removes the signs from the media path and stacks the signs in the compiler as controlled by the job-specific instructions. The compiler temporarily holds the signs during a first operation of the collating system as controlled by the job-specific instructions. Following actuation and reset of the collating system, the compiler moves the signs to the collating system as controlled by the job-specific instructions. The collating system collates compiled sets of signs into an ordered stack. The controller independently and automatically controls operation of the compiler and actuation of the collating system based on the job instructions defining the job-specific number and sequence of signs to continuously and dynamically order and collate the signs in coordination in real time with each different job-specific sequence and number of the signs as the signs are output from the transport device, without pausing between the different jobs.

According to exemplary sign processing apparatuses, a controller regularly receives a series of different jobs. Each of the jobs contains different job-specific instructions that each define a job-specific number and sequence of signs. A media supply supplies media to a processing path. A document-processing device is positioned along the processing path. The document-processing device comprises a printing engine. The printing engine prints marks on the media according to the job-specific instructions. A cutter is positioned along the media path and operatively connected to the controller. The cutter divides the media into individual signs according to the job-specific instructions. A transport device is positioned along the media path and operatively connected to the controller. A compiler is positioned along the media path and operatively connected to the controller. A collating system is connected to the compiler and operatively connected to the controller. The collating system comprises a ramped collator. The transport device removes the signs from the media path and stacks the signs into sets in the compiler as controlled by the job-specific instructions. The compiler temporarily holds one or more of the signs above the collating system during a first operation of the collating system as controlled by the job-specific instructions. Following actuation and reset of the collating system, the compiler drops the signs into the collating system as controlled by the job-specific instructions. The collating system collates compiled sets of signs into an ordered stack as controlled by the job-specific instructions.

According to exemplary methods herein, signs are created using a document-processing device. The signs are removed from a processing path of the document-processing device using a transport device to move the signs to a compiler. Ordered stacks of the signs are compiled in the compiler. The signs are temporarily held in the compiler during a first operation of a collating system. Following actuation and reset of the collating system, the signs are moved to the collating system.

According to a computer system for high speed compiling of sequentially ordered signage, the computer system comprises a program product comprising a tangible computer readable storage medium having program code embodied therewith. The program code is readable and executable by a computer to provide an application to perform a method. According to the method, signs are created using a document-processing device. The signs are removed from a processing path using a transport device to move the signs to a compiler. Ordered stacks of the signs are compiled in the compiler. The signs are temporarily held in the compiler during a first operation of a collating system. Following actuation and reset of the collating system, the signs are moved to the collating system.

These and other features are described in, or are apparent from, the following detailed description.

BRIEF DESCRIPTION OF THE DRAWINGS

Various examples of the systems and methods are described in detail below, with reference to the attached drawing figures, which are not necessarily drawn to scale and in which.

DETAILED DESCRIPTION

Figure 1:
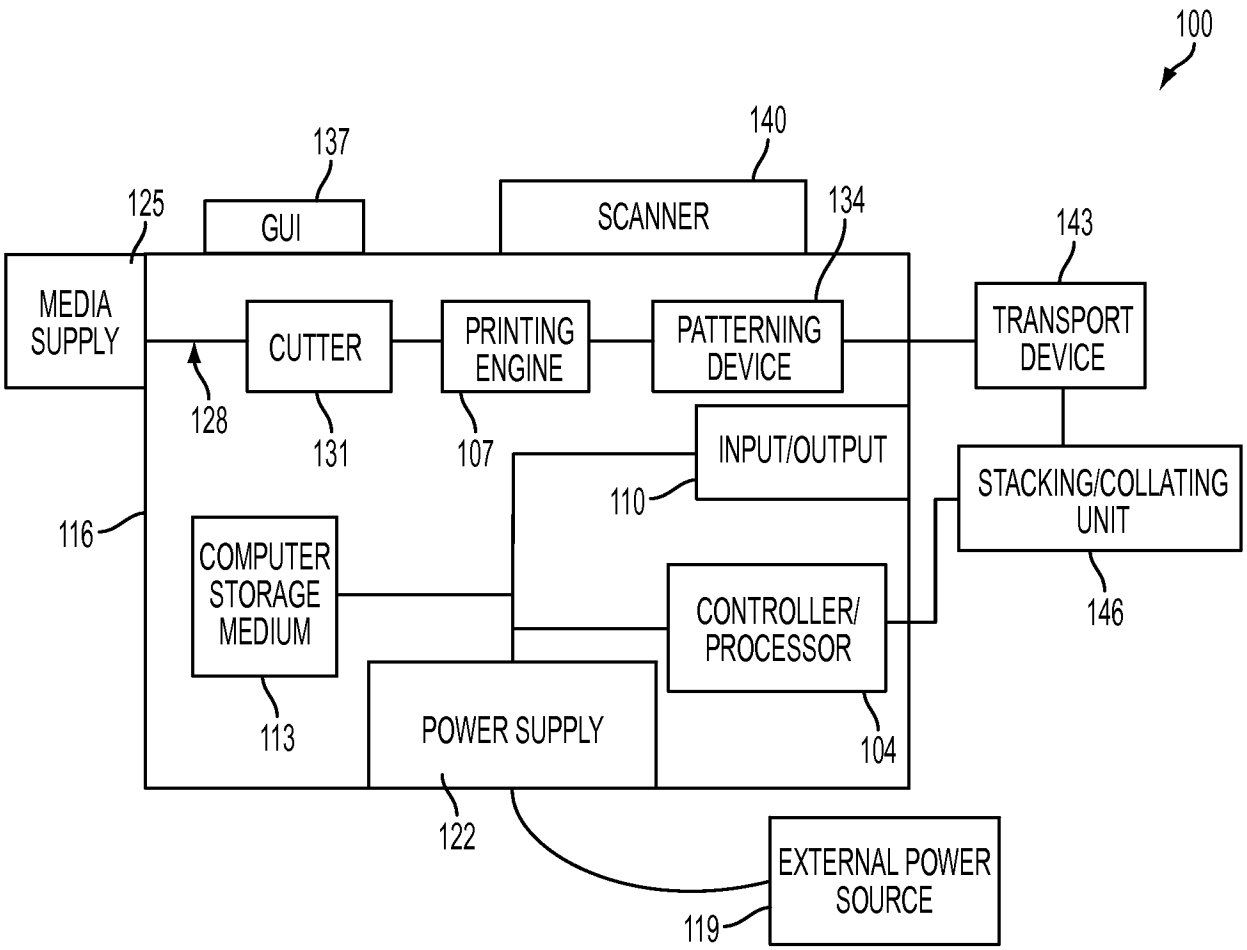
FIG. 1 is a side-view schematic diagram of a device according to systems and methods herein.

For a general understanding of the features of the disclosure, reference is made to the drawings. In the drawings, like reference numerals have been used throughout to identify identical elements. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

Referring now to the drawings, and more specifically to FIG. 1, what is illustrated is an exemplary sign processing apparatus 100, which can be used with methods herein. The apparatus 100 includes a controller/processor 104 and at least one marking device (printing engine(s)) 107 operatively connected to the controller/processor 104. The apparatus 100 may also include a communications port (Input/Output device 110) operatively connected to the controller/processor 104 and to a computerized network external to the apparatus 100. The Input/Output device 110 may be used for communications to and from the apparatus 100.

The controller/processor 104 controls the various actions of the apparatus 100, as described below. A non-transitory computer storage medium device 113 (which can be optical, magnetic, capacitor based, etc.) is readable by the controller/processor 104 and stores instructions that the controller/processor 104 executes to allow the apparatus 100 to perform its various functions, such as those described herein. Thus, as shown in FIG. 1, a body housing 116 has one or more functional components that operate on power supplied from an external power source 119, which may comprise an alternating current (AC) power source, through the power supply 122. The power supply 122 can comprise a power storage element (e.g., a battery) and connects to the external power source 119. The power supply 122 converts the power from the external power source 119 into the type of power needed by the various components of the apparatus 100.

The sign processing apparatus 100 herein has a media supply 125 supplying media to a media path 128. The media path 128 can comprise any combination of belts, rollers, nips, drive wheels, vacuum devices, air devices, etc. The printing engine 107 is positioned along the media path 128. That is, the sign processing apparatus 100 comprises a document-processing device having the printing engine 107. The printing engine 107 prints marks on the media. Further, a cutter 131 may be positioned along the media path 128, and the cutter 131 divides (cuts) the media into individual workpieces 202 (FIG. 2), such as signs.

While signs are used as an example of the type of workpiece that can be processed with the embodiments herein, those ordinarily skilled in the art understand that virtually any form of workpiece that can be stacked could be used with the disclosed structures and methods, and the claims are not limited only to signs. Therefore, signs, sheets of paper, cards, pieces of plastic, etc., as well as many other items could be the workpieces processed by the systems and methods herein.

A patterning device 134 may be positioned along the media path 128. The cutter 131 and the patterning device 134 can be combined into a single device or can be separate devices, depending upon the specific configuration. Further, the printing engine 107, cutter 131, and patterning device 134 can be positioned in any order along the media path 128, and the order shown is purely arbitrary.

In addition, the sign processing apparatus 100 can include at least one accessory functional component, such as a graphic user interface (GUI) assembly 137, an optical scanner 140, or other accessory functional component (such as a document handler, automatic document feeder (ADF), etc.) that operate on the power supplied from the external power source 119 (through the power supply 122).

A transport device 143 is additionally positioned along the media path 128. The transport device 143 moves the workpieces 202 from the media path 128 and places the workpieces 202 into a compiling/collating system 146.

As would be understood by those ordinarily skilled in the art, the sign processing apparatus 100 shown in FIG. 1 is only one example and the systems and methods herein are equally applicable to other types of devices that may include fewer components or more components. For example, while a limited number of printing engines and paper paths are illustrated in FIG. 1, those ordinarily skilled in the art would understand that many more paper paths and additional printing engines could be included within any device used with embodiments herein.

Figure 2:
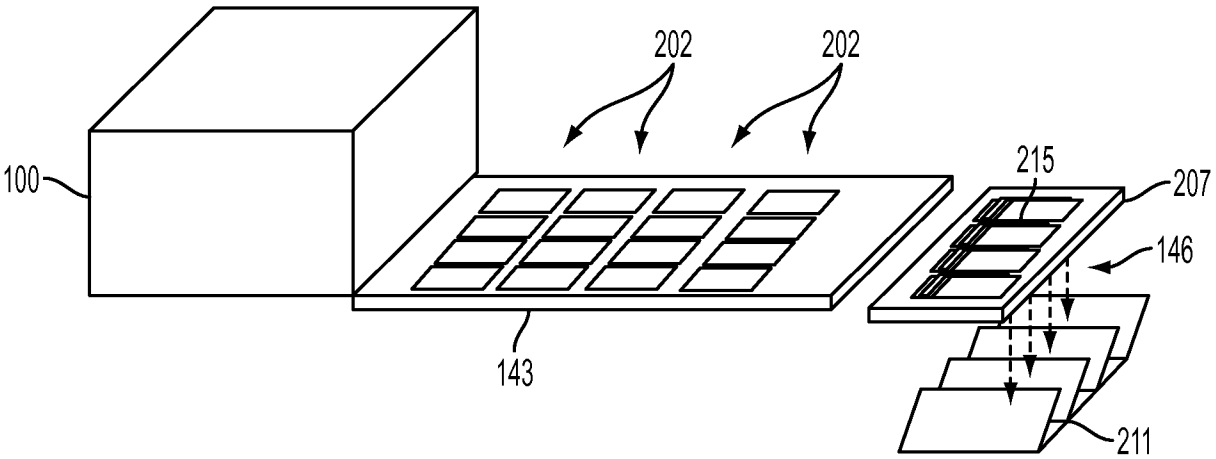
FIG. 2 is a perspective view schematic diagram of a device according to systems and methods herein.

As shown in FIG. 2, the transport device 143 moves workpieces 202 into the compiling/collating system 146, which comprises a buffer/compiler 207 and a collator 211. According to systems and methods herein, the collator 211 may comprise a high-speed sequential cross-process collator. The buffer/compiler 207 holds one or more workpieces 202 in stacks 215 above the collator 211 to allow time for the collator 211 to actuate and reset before the next stack 215 of workpieces 202 are collated.

Figure 3:
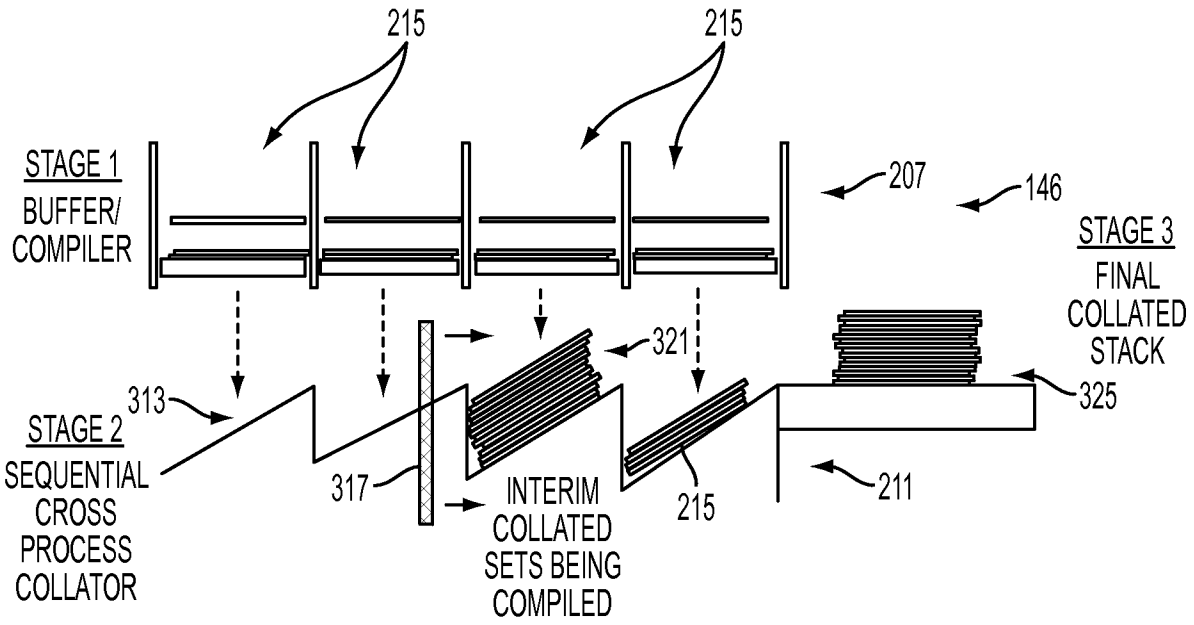
FIG. 3 is a side view of an exemplary compiler and collator according to systems and methods herein.

As shown in FIG. 3, the collator 211 comprises a series of ramps 313 and a pusher 317 that moves each of the interim stacks 321 toward a final collated stack 325. The compiling and collating process is divided into stages, as shown in FIG. 3. In the first stage, the workpieces 202 are output from the sign processing apparatus 100 into the buffer/compiler 207 where they are compiled in stacks 215. The workpieces 202 in the stacks 215 are in a predetermined sequential order as controlled by the controller/processor 104. In the second stage, the stacks 215 are dropped onto the ramps 313 of the collator 211. In the third stage, the pusher 317 sweeps the stacks 215 in sequential order onto the interim stacks 321. The final collated stack 325 contains a predetermined number of workpieces in a known order as controlled by the controller/processor 104. The multi-stage process allows the transport device 143 to stack the workpieces 202 in the buffer/compiler 207 for temporary holding in order to provide the time needed for previous sets to be collated underneath. This allows the pusher 317 to move the interim stacks 321 into a final collated stack 325 and to return to a starting position prior to dropping the next stacks 215 down into the collator 211.

Figure 4:
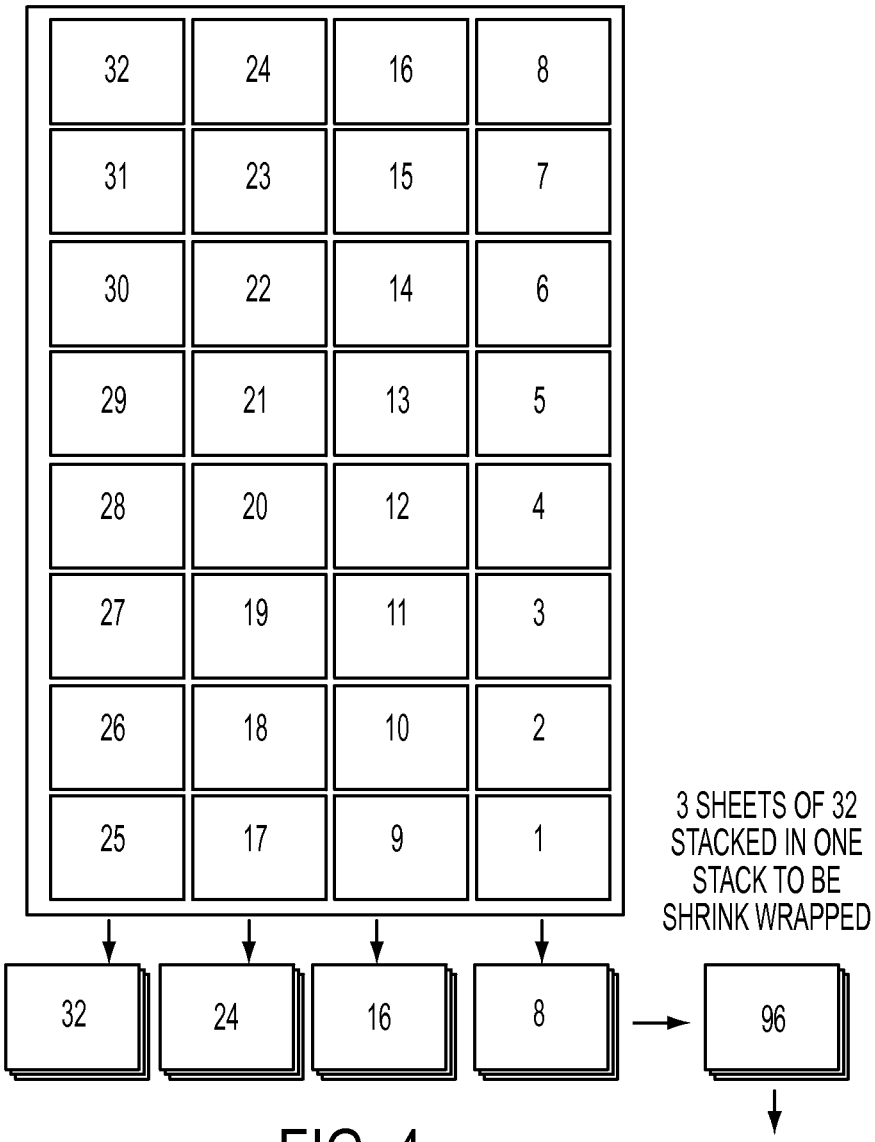
FIG. 4 is a plan view of a collating scheme according to systems and methods herein.

The collation problem is illustrated by referring to FIG. 4. For stores that change signage frequently, the store signage is required to be in the per store planogram order. To achieve this, the cards are imposed so that each sheet is in sequential order within the sheet and then across the sheets. In the example shown in FIG. 4, the cards must be delivered to the stores in stacks of 96 cards each, which uses three 32-UP sheets that are collated sequentially to produce one final stack. In this example, a first sheet is divided into four compiled first stacks of 8 cards. Then, a second sheet is divided into four compiled second stacks of 8 cards and compiled onto the first stacks. Finally, a third sheet is divided into four compiled third stacks of 8 cards and compiled onto the first and second stacks. Each of the four compiled stacks contains 24 cards. The compiled stacks are then moved to the collator. In the collator, four compiled sets of 24 cards each are stacked into one stack by jumping each set onto the next to create the final ordered stack. Note: the sheet layout in FIG. 4 shows a left to right collation; however, it is contemplated that the system could also be collated right to left, so the numbering would be reversed.

Each store, however, may utilize a different number of stacks. For example, stores may use approximately 7200 cards +/−~600 cards per week. This results in a differing number of stacks per store. In some cases, the last stack will be less than 96 cards and can require only one sheet per collated stack. In order to allow enough time to meet the per sheet timing allowed for the last stack, the collator 211 must reset (i.e., the pusher 317 returns to the starting position) and collate in the time for one sheet to be compiled.

In order to accomplish this, the collator 211 sweeps cards fast enough to allow the pusher 317 to return to home to push the next set. Even with three sheets of 32 cards to create the 96-card stack, the system moves the pusher 317 at a velocity, which may cause the interim stacks 321 to skew, bounce, and float, causing poor stacking. For a single sheet that makes up the last set, if it is less than 33 cards, the pusher 317 must return in one sheet's process time.

The multi-stage solution herein provides the time needed to create a controlled, ordered collation by allowing the upstream sheets a buffer compiling area as the lower collation unit creates the final collated stack 325. Furthermore, reducing the velocity of the pusher 317 reduces the kinetic impact of the pusher 317. This reduces misregistration and disturbance of the interim stacks 321 of workpieces 202 as they are collated into the final collated stack 325.

In other words, the controller/processor 104 regularly receives a series of different jobs. Each of the jobs contains different job-specific instructions that each define a job-specific number and sequence of workpieces 202. The controller/processor 104 independently and automatically controls operation of the buffer/compiler 207 and actuation of the compiling/collating system 146 based on the job instructions defining the job-specific number and sequence of workpieces 202 to continuously and dynamically order and collate the workpieces 202 in coordination in real time with each different job-specific sequence and number of the workpieces 202 as the workpieces 202 are output from the transport device 143, without pausing between the different jobs.

With systems and methods herein, a multi-stage compiling and collating system is provided for high speed stacking of ordered store signage/cards/sheets. Workpieces 202 are received from the printer/cutter system and are temporarily compiled while workpieces 202 are being collated into a sequentially ordered stack. The compiling/collating system 146 is capable of stacking sheet-by-sheet sequentially imposed imaged cards at high speed by using the multiple compiling/collation and stacking stages described with reference to FIG. 3. Accordingly, the compiling/collating system 146 is capable of presenting store signage in planogram order to the stores with a sheet-to-sheet imposition that minimizes media scrap percentages.

To attain the throughput and reduce the collator's cross process speed, a temporary compiler is combined with a cross process ramped compiler to create ordered stacks of in-store signage. This allows the system to produce the card stacks at the high throughput rates required to create the stacks. Additionally, this system architecture provides a platform for higher future speeds. The last set is often less than the full 96 cards and will then be made up of 1, 2, or 3 sheets. Each of these scenarios has different processing times with the single sheet i.e. 32 card final stack presenting only one sheet's timing for the return of the pusher. The temporary compiler with the cross process set ordering ramped collator allows for the ordered sets to be created using a sheet-by-sheet imposition at high speed.

Figure 5:
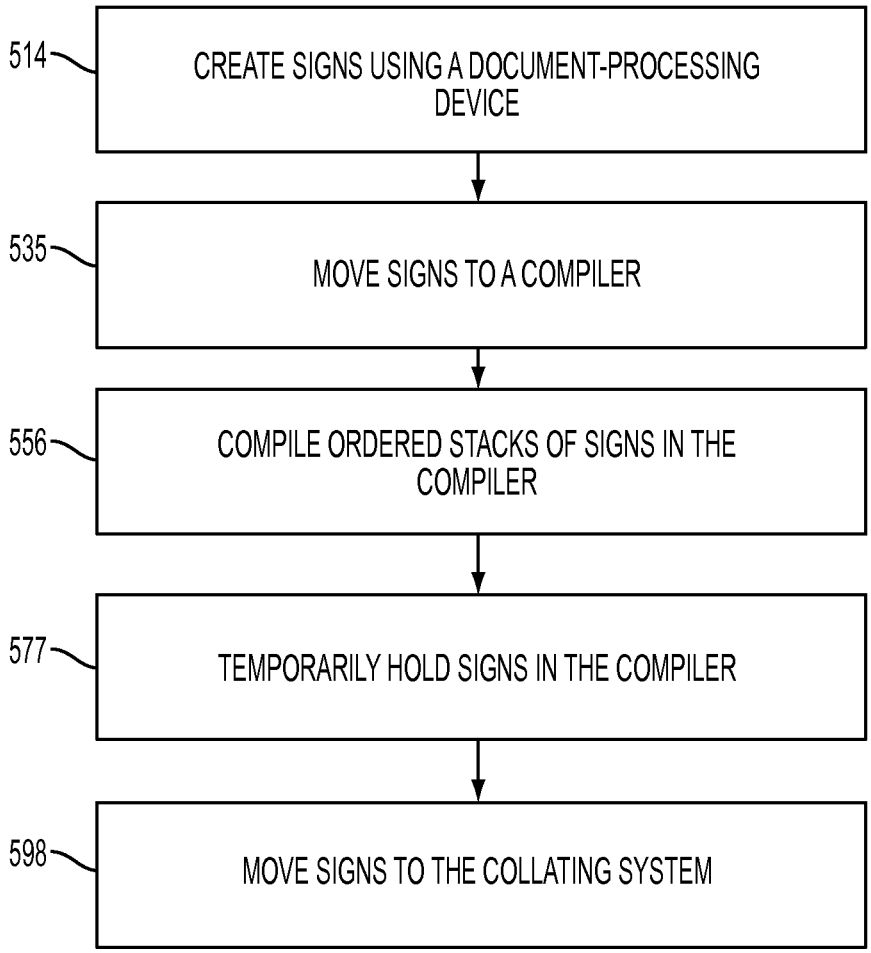
FIG. 5 is a flow diagram illustrating methods herein.

FIG. 5 is a flow diagram illustrating the processing flow of an exemplary method according to the present disclosure. The method is useful for high speed compiling of sequentially ordered signage. At 514, signs are created using a document-processing device. The signs are moved to a compiler, at 535. The signs are removed from a processing path of the document-processing device using a transport device. Ordered stacks of the signs are compiled in the compiler, at 556. At 577, the signs are temporarily held in the compiler during a first operation of a collating system. Following actuation and reset of the collating system, the signs are moved to the collating system, at 598.

That is, as described above, a sign processing apparatus 100, including a document-processing device, is positioned along a processing path 128. The document-processing device creates sign workpieces 202. The document-processing device comprises a controller/processor 104 regularly receiving a series of different jobs, each of the jobs containing different job-specific instructions that each define a job-specific number and sequence of sign workpieces 202. A transport device 143 is positioned along the processing path 128. The transport device 143 is operatively connected to the controller/processor 104. A buffer/compiler 207 is positioned along the processing path 128. The buffer/compiler 207 is operatively connected to the controller/processor 104. A compiling/collating system 146 is connected to the buffer/compiler 207. The compiling/collating system 146 is operatively connected to the controller/processor 104. The transport device 143 removes the sign workpieces 202 from the processing path 128 and stacks the sign workpieces 202 in the buffer/compiler 207 as controlled by the job-specific instructions. The buffer/compiler 207 temporarily holds the sign workpieces 202 during a first operation of the collator 211 as controlled by the job-specific instructions. Following actuation and reset of the collator 211, the buffer/compiler 207 moves the sign workpieces 202 to the collator 211 as controlled by the job-specific instructions. The controller/processor 104 independently and automatically controls operation of the buffer/compiler 207 and actuation of the compiling/collating system 146 based on the job instructions defining the job-specific number and sequence of sign workpieces 202 to continuously and dynamically order and collate sign workpieces in coordination in real time with each different job-specific sequence and number of the workpieces as the workpieces are output from the transport device 143, without pausing between the different jobs.

Figure 6:
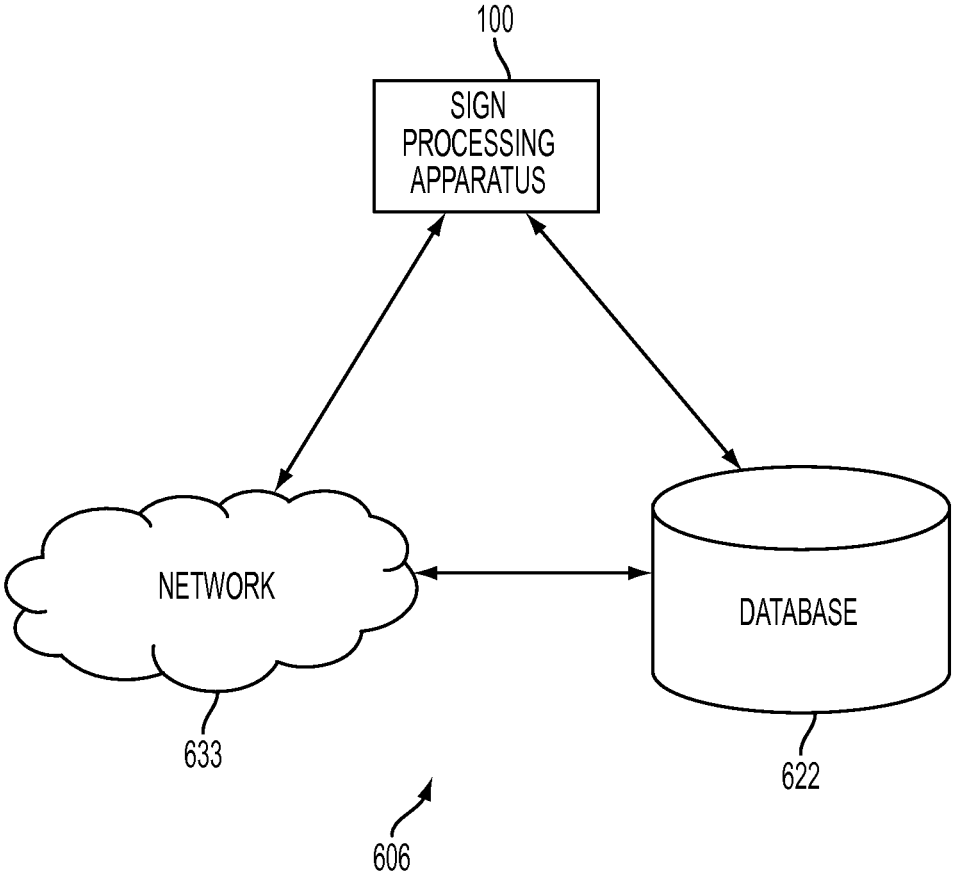
FIG. 6 is a block diagram of a network according to systems and methods herein.

FIG. 6 is a general overview block diagram of a network, indicated generally as 606, for communication between the sign processing apparatus 100 and a database 622. The sign processing apparatus 100 may comprise any form of processor as described in detail above. The sign processing apparatus 100 can be programmed with appropriate application software to implement the methods described herein. Alternatively, the sign processing apparatus 100 is a special purpose machine that is specialized for processing document (sign) data and includes a dedicated processor that would not operate like a general purpose processor because the dedicated processor has application specific integrated circuits (ASICs) that are specialized for the handling of document processing operations, processing patterning and cutting data, information for compiling and collating documents, etc. In one example, the sign processing apparatus 100 is special purpose machine that includes a specialized card having unique ASICs for providing cutting, compiling, and collating processing instructions, includes specialized boards having unique ASICs for input and output devices to speed network communications processing, a specialized ASIC processor that performs the logic of the methods described herein (such as the processing shown in FIG. 5) using dedicated unique hardware logic circuits, etc.

Database 622 includes any database or any set of records or data that the sign processing apparatus 100 desires to retrieve. Database 622 may be any organized collection of data operating with any type of database management system. The database 622 may contain matrices of datasets comprising multi-relational data elements.

The database 622 may communicate with the sign processing apparatus 100 directly. Alternatively, the database 622 may communicate with the sign processing apparatus 100 over network 633. The network 633 comprises a communication network either internal or external, for affecting communication between the sign processing apparatus 100 and the database 622. For example, network 633 may comprise a local area network (LAN) or a global computer network, such as the Internet.

Aspects of the present disclosure are described herein with reference to flowchart illustrations and/or block diagrams of methods, apparatus (systems), and computer program products according to various systems and methods. It will be understood that each block of the flowchart illustrations and/or two-dimensional block diagrams, and combinations of blocks in the flowchart illustrations and/or block diagrams, can be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the processes/acts specified in the flowchart and/or block diagram block or blocks.

According to a further system and method herein, an article of manufacture is provided that includes a tangible computer readable medium having computer readable instructions embodied therein for performing the steps of the computer implemented methods, including, but not limited to, the method illustrated in FIG. 5. Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. Any of these devices may have computer readable instructions for carrying out the steps of the methods described above with reference to FIG. 5.

The computer program instructions may be stored in a computer readable medium that can direct a computer, other programmable data processing apparatus, or other devices to process in a particular manner, such that the instructions stored in the computer readable medium produce an article of manufacture including instructions which implement the process/act specified in the flowchart and/or block diagram block or blocks.

Furthermore, the computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the processes/acts specified in the flowchart and/or block diagram block or blocks.

In case of implementing the systems and methods herein by software and/or firmware, a program constituting the software may be installed into a computer with dedicated hardware, from a storage medium or a network, and the computer is capable of performing various processes if with various programs installed therein.

In the case where the above-described series of processing is implemented with software, the program that constitutes the software may be installed from a network such as the Internet or a storage medium such as the removable medium.

Those skilled in the art would appreciate that the storage medium is not limited to a peripheral device having the program stored therein, which is distributed separately from the device for providing the program to the user. Examples of a removable medium include a magnetic disk (including a floppy disk), an optical disk (including a Compact Disk-Read Only Memory (CD-ROM) and a Digital Versatile Disk (DVD)), a magneto-optical disk (including a Mini-Disk (MD) (registered trademark)), and a semiconductor memory. Alternatively, the computer storage medium 720 may be a hard disk, or the like, which has the program stored therein and is distributed to the user together with the device that contains them.

As will be appreciated by one skilled in the art, aspects of the devices and methods herein may be embodied as a system, method, or computer program product. Accordingly, aspects of the present disclosure may take the form of an entirely hardware system, an entirely software system (including firmware, resident software, micro-code, etc.) or an system combining software and hardware aspects that may all generally be referred to herein as a 'circuit', 'module, or 'system.' Furthermore, aspects of the present disclosure may take the form of a computer program product embodied in one or more computer readable medium(s) having computer readable program code embodied thereon.

Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a Read Only Memory (ROM), an Erasable Programmable Read Only Memory (EPROM or Flash memory), an optical fiber, a magnetic storage device, a portable compact disc Read Only Memory (CD-ROM), an optical storage device, a "plug-and-play" memory device, like a USB flash drive, or any suitable combination of the foregoing. In the context of this document, a computer readable storage medium may be any tangible medium that can contain, or store a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++, or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowchart and block diagrams in the figures illustrate the architecture, functionality, and operation of possible implementations of systems, methods, and computer program products according to various devices and methods herein. In this regard, each block in the flowchart or block diagrams may represent a module, segment, or portion of code, which comprises one or more executable instructions for implementing the specified logical process(s). It should also be noted that, in some alternative implementations, the processes noted in the block might occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified processes or acts, or combinations of special purpose hardware and computer instructions.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, instead, the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, processors, etc., are well-known and readily available devices produced by manufacturers such as Dell Computers, Round Rock TX, USA and Apple Computer Co., Cupertino CA, USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

The terminology used herein is for the purpose of describing particular examples of the disclosed structures and methods and is not intended to be limiting of this disclosure. For example, as used herein, the singular forms 'a', 'an', and 'the' are intended to include the plural forms as well, unless the context clearly indicates otherwise. Additionally, as used herein, the terms 'comprises', 'comprising', and/or 'including', when used in this specification, specify the presence of stated features, integers, steps, operations, elements, and/or components, but do not preclude the presence or addition of one or more other features, integers, steps, operations, elements, components, and/or groups thereof. Further, the terms 'automated' or 'automatically' mean that once a process is started (by a machine or a user), one or more machines perform the process without further input from any user.

The corresponding structures, materials, acts, and equivalents of all means or step plus process elements in the claims below are intended to include any structure, material, or act for performing the process in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and processes, or alternatives thereof, may be desirably combined into many other different systems or applications. Those skilled in the art may subsequently make various presently unforeseen or unanticipated alternatives, modifications, variations, or improvements therein, which are also intended to be encompassed by the following claims. Unless specifically defined in a specific claim itself, steps or components of the systems and methods herein should not be implied or imported from any above example as limitations to any particular order, number, position, size, shape, angle, color, temperature, or material.

What is claimed is:

1. A system comprising:

a document-processing device positioned along a processing path, said document-processing device creating sign workpieces, said document-processing device comprising a controller regularly receiving a series of different jobs, each of said jobs containing different job-specific instructions that each define a job-specific number and sequence of sign workpieces;

a transport device positioned along said processing path, said transport device being operatively connected to said controller;

a compiler positioned along said processing path, said compiler being operatively connected to said controller; and a collating system connected to said compiler, said collating system being operatively connected to said controller, said transport device removing said sign workpieces from said processing path of said document-processing device and stacking said sign workpieces in said compiler as controlled by said job-specific instructions, said compiler comprising a plurality of bins temporarily holding said sign workpieces above said collating system during a first operation of said collating system as controlled by said job-specific instructions, said collating system comprising:

a series of ramps, each ramp of said series of ramps receiving a stack of sign workpieces from each bin of said compiler, said sign workpieces being in a predetermined sequential order as controlled by said job-specific instructions, and a pusher, said pusher moving each stack of sign workpieces received from said compiler in sequential order such that a first stack of sign workpieces on a first ramp is deposited on top of a second stack of sign workpieces on an adjacent second ramp as said sign workpieces are moved toward a final collated stack, following actuation and reset of said collating system, said compiler moving said sign workpieces to said collating system as controlled by said job-specific instructions, and said controller independently and automatically controlling operation of said compiler and actuation of said collating system based on said job instructions defining said job-specific number and sequence of sign workpieces to continuously and dynamically order and collate sign workpieces in coordination in real time with each different job-specific sequence and number of said sign workpieces as said sign workpieces are output from said transport device, without pausing between said different jobs.

2. The system according to claim 1, further comprising:

a cutter operatively connected to said controller, said cutter cutting individual sign workpieces from relatively larger sheets, said cutter cutting and outputting said sign workpieces in said job-specific number and sequence to said transport device as controlled by said job-specific instructions.

3. The system according to claim 1, said compiler dropping said sign workpieces onto said collating system as controlled by said job-specific instructions.

4. The system according to claim 1, further comprising:

a media supply supplying media to a media path; and a printing engine positioned along said media path, said printing engine printing marks on said media according to said job-specific instructions.

5. A sign processing apparatus comprising:

a controller regularly receiving a series of different jobs, each of said jobs containing different job-specific instructions that each define a job-specific number and sequence of signs;

a media supply supplying media to a media path;

a printing engine positioned along said media path, said printing engine printing marks on said media according to said job-specific instructions;

a cutter positioned along said media path, said cutter being operatively connected to said controller, said cutter dividing said media into individual signs according to said job-specific instructions;

a transport device positioned along said media path, said transport device being operatively connected to said controller;

a compiler positioned along said media path, said compiler being operatively connected to said controller; and a collating system connected to said compiler, said collating system being operatively connected to said controller, said transport device removing said signs from said media path and stacking said signs in said compiler as controlled by said job-specific instructions, said compiler comprising a plurality of bins temporarily holding said signs above said collating system during a first operation of said collating system as controlled by said job-specific instructions, said collating system comprising:

a series of ramps, each ramp of said series of ramps receiving a stack of signs from each bin of said compiler, said signs being in a predetermined sequential order as controlled by said job-specific instructions, and a pusher, said pusher moving interim stacks of signs received from said compiler in sequential order such that a first stack of signs on a first ramp is deposited on top of a second stack of signs on an adjacent second ramp as said signs are moved toward a final collated stack, and following actuation and reset of said collating system, said compiler moving said signs to said collating system as controlled by said job-specific instructions, said collating system collating compiled sets of signs into an ordered stack.

6. The sign processing apparatus according to claim 5, said compiler dropping said signs onto said collating system as controlled by said job-specific instructions.

7. The sign processing apparatus according to claim 5, said controller independently and automatically controlling operation of said compiler and actuation of said collating system based on said job instructions defining said job-specific number and sequence of signs.

8. The sign processing apparatus according to claim 7, said controller continuously and dynamically ordering and collating said signs in coordination in real time with each different job-specific sequence and number of said signs as said signs are output from said transport device, without pausing between said different jobs.

9. A sign processing apparatus comprising:

a controller regularly receiving a series of different jobs, each of said jobs containing different job-specific instructions that each define a job-specific number and sequence of signs;

a media supply supplying media to a processing path;

a document-processing device positioned along said processing path, said document-processing device comprising a printing engine, said printing engine printing marks on said media according to said job-specific instructions;

a cutter positioned along said processing path, said cutter being operatively connected to said controller, said cutter dividing said media into individual signs according to said job-specific instructions;

a transport device positioned along said processing path, said transport device being operatively connected to said controller;

a compiler positioned along said processing path, said compiler being operatively connected to said controller, said compiler comprising a plurality of bins; and a collating system connected to said compiler, said collating system comprising a series of ramps, each ramp of said series of ramps receiving a stack of signs from each bin of said compiler, said signs being in a predetermined sequential order as controlled by said job-specific instructions, said collating system being operatively connected to said controller, said transport device removing said signs from said processing path and stacking said signs into sets in said plurality of bins of said compiler as controlled by said job-specific instructions, said compiler temporarily holding one or more of said signs above said collating system during a first operation of said collating system as controlled by said job-specific instructions, following actuation and reset of said collating system, said compiler dropping said signs into said collating system as controlled by said job-specific instructions, said collating system further comprising a pusher moving each stack of signs received from said compiler in sequential order such that a first stack of signs on a first ramp is deposited on top of a second stack of signs on an adjacent second ramp as said signs are moved toward a final collated stack, and said collating system collating compiled sets of signs into an ordered stack as controlled by said job-specific instructions.

10. The sign processing apparatus according to claim 9, said reset of said collating system comprising said pusher being returned to a starting position as controlled by said job-specific instructions.

11. The sign processing apparatus according to claim 9, said controller independently and automatically controlling operation of said compiler and actuation of said collating system based on said job instructions defining said job-specific number and sequence of signs.

12. The sign processing apparatus according to claim 11, said controller continuously and dynamically ordering and collating said signs in coordination in real time with each different job-specific sequence and number of said signs as said signs are output from said transport device, without pausing between said different jobs.

* * * * *